US009803438B2

(12) United States Patent
Stokes et al.

(10) Patent No.: US 9,803,438 B2
(45) Date of Patent: Oct. 31, 2017

(54) EXPANDABLE BULLNOSE ASSEMBLY FOR USE WITH A WELLBORE DEFLECTOR

(71) Applicant: Halliburton Energy Services, Inc., Houston, TX (US)

(72) Inventors: Matthew Bradley Stokes, Fort Worth, TX (US); Borisa Lajesic, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 15/016,513

(22) Filed: Feb. 5, 2016

(65) Prior Publication Data

US 2016/0153253 A1 Jun. 2, 2016

Related U.S. Application Data

(62) Division of application No. 14/358,777, filed as application No. PCT/US2013/052105 on Jul. 25, 2013, now Pat. No. 9,284,802.

(51) Int. Cl.

| | |
|---|---|
| ***E21B 23/12*** | (2006.01) |
| ***E21B 19/24*** | (2006.01) |
| ***E21B 41/00*** | (2006.01) |
| ***E21B 7/06*** | (2006.01) |

(52) U.S. Cl.

CPC ..... *E21B 23/002* (2013.01); *E21B 7/061* (2013.01); *E21B 19/24* (2013.01); *E21B 41/0035* (2013.01)

(58) Field of Classification Search

CPC ..... E21B 41/0035; E21B 7/061; E21B 23/002

See application file for complete search history.

(56) References Cited

U.S. PATENT DOCUMENTS 7,669,664 B2 3/2010 McGarian et al.

OTHER PUBLICATIONS

Supplementary European Search Report dated Nov. 28, 2016 in EP13890068.

*Primary Examiner* — Robert E Fuller

(74) *Attorney, Agent, or Firm* — McDermott Will & Emery LLP

(57) ABSTRACT

A method includes introducing a bullnose assembly into a main bore of a wellbore, the bullnose assembly including a body and a bullnose tip actuatable between a default configuration, where a collet body forming part of the bullnose tip exhibits a first diameter, and an actuated configuration, where the collet body exhibits a second diameter different than the first diameter. The bullnose assembly is then advanced to a deflector arranged within the main bore and defining a first channel that exhibits a predetermined diameter and communicates with a lower portion of the main bore, and a second channel that communicates with a lateral bore. The bullnose assembly is then directed into either the lower portion of the main bore or the lateral bore based on a diameter of the collet body as compared to the predetermined diameter.

14 Claims, 6 Drawing Sheets

EXPANDABLE BULLNOSE ASSEMBLY FOR USE WITH A WELLBORE DEFLECTOR

CROSS-REFERENCE TO RELATED APPLICATIONS

The present application is a divisional patent of U.S. patent application Ser. No. 14/358,777, filed on May 16, 2014, and which claims priority to International Patent App. No. PCT/US2013/052105, filed on Jul. 25, 2013.

BACKGROUND

The present disclosure relates generally to multilateral wellbores and, more particularly, to an expandable bullnose assembly that works with a wellbore deflector to allow entry into more than one lateral wellbore of a multilateral wellbore.

Hydrocarbons can be produced through relatively complex wellbores traversing a subterranean formation. Some wellbores include one or more lateral wellbores that extend at an angle from a parent or main wellbore. Such wellbores are commonly called multilateral wellbores. Various devices and downhole tools can be installed in a multilateral wellbore in order to direct assemblies toward a particular lateral wellbore. A deflector, for example, is a device that can be positioned in the main wellbore at a junction and configured to direct a bullnose assembly conveyed downhole toward a lateral wellbore. Depending on various parameters of the bullnose assembly, some deflectors also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly oriented within the well and otherwise requires assistance from known gravitational forces. Moreover, conventional bullnose assemblies are typically only able to enter a lateral wellbore at a junction where the design parameters of the deflector correspond to the design parameters of the bullnose assembly. In order to enter another lateral wellbore at a junction having a differently designed deflector, the bullnose assembly must be returned to the surface and replaced with a bullnose assembly exhibiting design parameters corresponding to the differently designed deflector. This process can be time consuming and costly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to multilateral wellbores and, more particularly, to an expandable bullnose assembly that works with a wellbore deflector to allow entry into more than one lateral wellbore of a multilateral wellbore.

Disclosed is a bullnose assembly that is able to expand its diameter while downhole such that it is able to be accurately deflected into either a main wellbore or a lateral wellbore using a deflector. The deflector has a first channel that communicates to lower portions of the main wellbore, and a second channel that communicates with the lateral wellbore. If the diameter of the bullnose assembly is smaller than the diameter of the first channel, the bullnose assembly will be directed into the lower portions of the main wellbore. Alternatively, if the diameter of the bullnose assembly is larger than the diameter of the first channel, the bullnose assembly will be directed into the lateral wellbore. The variable nature of the disclosed bullnose assemblies allows for selective and repeat re-entry of any number of stacked multilateral wells having multiple junctions that are each equipped with the deflector.

Figure 1:
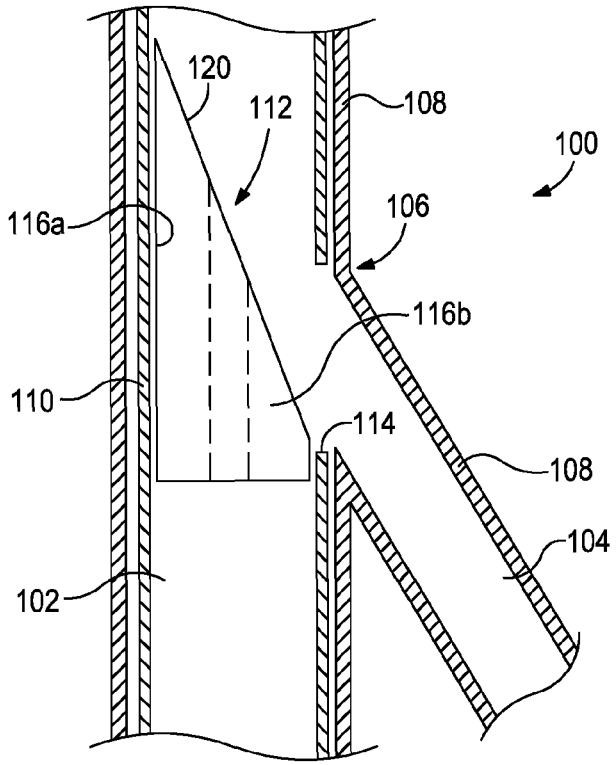
FIG. 1 illustrates an exemplary well system that may employ one or more principles of the present disclosure, according to one or more embodiments.

Referring to FIG. 1, illustrated is an exemplary well system 100 that may employ one or more principles of the present disclosure, according to one or more embodiments. The well system 100 includes a main bore 102 and a lateral bore 104 that extends from the main bore 102 at a junction 106 in the well system 100. The main bore 102 may be a wellbore drilled from a surface location (not shown), and the lateral bore 104 may be a lateral or deviated wellbore drilled at an angle from the main bore 102. While the main bore 102 is shown as being oriented vertically, the main bore 102 may be oriented generally horizontal or at any angle between vertical and horizontal, without departing from the scope of the disclosure.

In some embodiments, the main bore 102 may be lined with a casing string 108 or the like, as illustrated. The lateral bore 104 may also be lined with casing string 108. In other embodiments, however, the casing string 108 may be omitted from the lateral bore 104 such that the lateral bore 104 may be formed as an "open hole" section, without departing from the scope of the disclosure.

In some embodiments, a tubular string 110 may be extended within the main bore 102 and a deflector 112 may be arranged within or otherwise form an integral part of the tubular string 110 at or near the junction 106. The tubular string 110 may be a work string extended downhole within the main bore 102 from the surface location and may define or otherwise provide a window 114 therein such that downhole tools or the like may exit the tubular string 110 into the lateral bore 104. In other embodiments, the tubular string 110 may be omitted and the deflector 112 may instead be arranged within the casing string 108, without departing from the scope of the disclosure.

As discussed in greater detail below, the deflector 112 may be used to direct or otherwise guide a bullnose assembly (not shown) either further downhole within the main bore 102, or into the lateral bore 104. To accomplish this, the deflector 112 may include a first channel 116*a* and a second channel 116*b*. The first channel 116*a* may exhibit a predetermined width or diameter 118. Any bullnose assemblies that are smaller than the predetermined diameter 118 may be directed into the first channel 116*a* and subsequently to lower portions of the main bore 102. In contrast, bullnose assemblies that are greater than the predetermined diameter 118 may slidingly engage a ramped surface 120 that forms an integral part or extension of the second channel 116*b* and otherwise serves to guide or direct a bullnose assembly into the lateral bore 104.

Figure 2A:
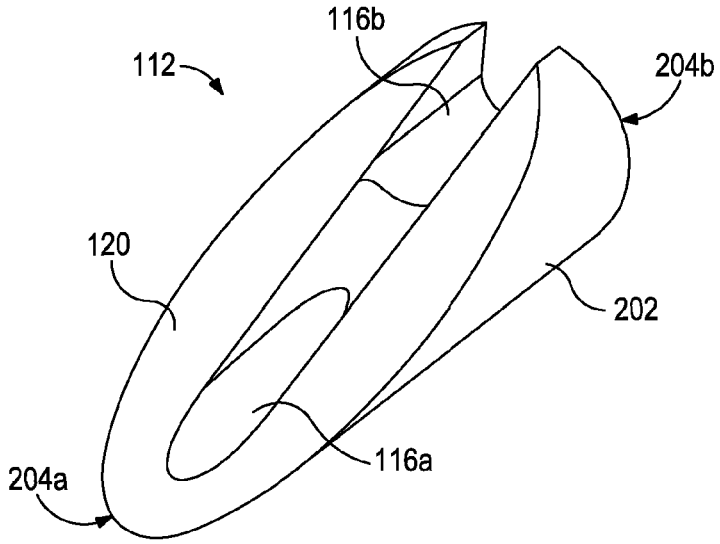
FIGS. 2A-2C illustrate isometric, top, and end views, respectively, of the deflector of FIG. 1, according to one or more embodiments.
Figure 2B:
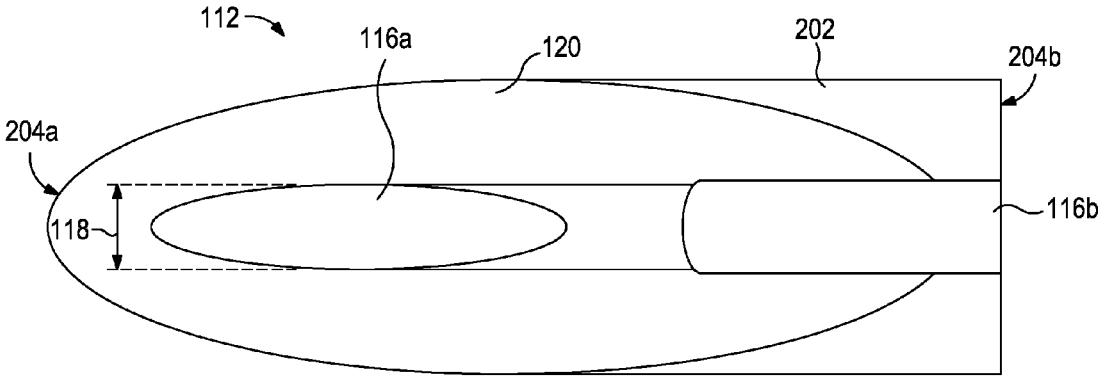
Figure 2C:
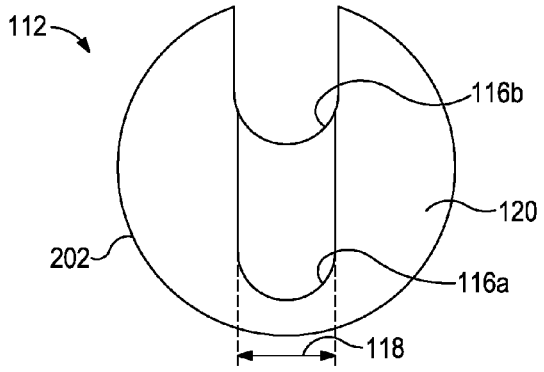

Referring now to FIGS. 2A-2C, with continued reference to FIG. 1, illustrated are isometric, top, and end views, respectively of the deflector 112 of FIG. 1, according to one or more embodiments. The deflector 112 may have a body 202 that provides a first end 204*a* and a second end 204*b*. The first end 204*a* may be arranged on the uphole end (i.e., closer to the surface of the wellbore) of the main bore 102 (FIG. 1) and the second end 204*b* may be arranged on the downhole end (i.e., closer to the toe of the wellbore) of the main bore 102. FIG. 2C, for example, is a view of the deflector 112 looking at the first end 204*a*.

As illustrated, the deflector 112 may provide the first channel 116*a* and the second channel 116*b*, as generally described above. The deflector 112 may further provide or otherwise define the ramped surface 120 (not shown in FIG. 2C) that generally extends from the first end 204*a* to the second channel 116*b* and otherwise forms an integral part or portion thereof. As indicated, the first channel 116*a* extends through the ramped surface 120 and exhibits the predetermined diameter 118 discussed above. Accordingly, any bullnose assemblies (not shown) having a diameter that is smaller than the predetermined diameter 118 may be guided through the ramped surface 120 and otherwise into the first channel 116*a* and subsequently to lower portions of the main bore 102. In contrast, bullnose assemblies having a diameter that is greater than the predetermined diameter 118 will ride up the ramped surface 120 and into the second channel 116*b* which feeds the lateral bore 104.

Figure 3A:
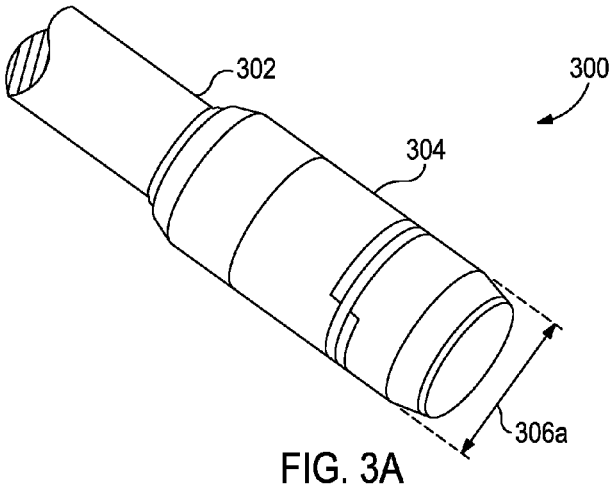
FIGS. 3A and 3B illustrate isometric and cross-sectional side views, respectively, of an exemplary bullnose assembly, according to one or more embodiments.
Figure 3B:
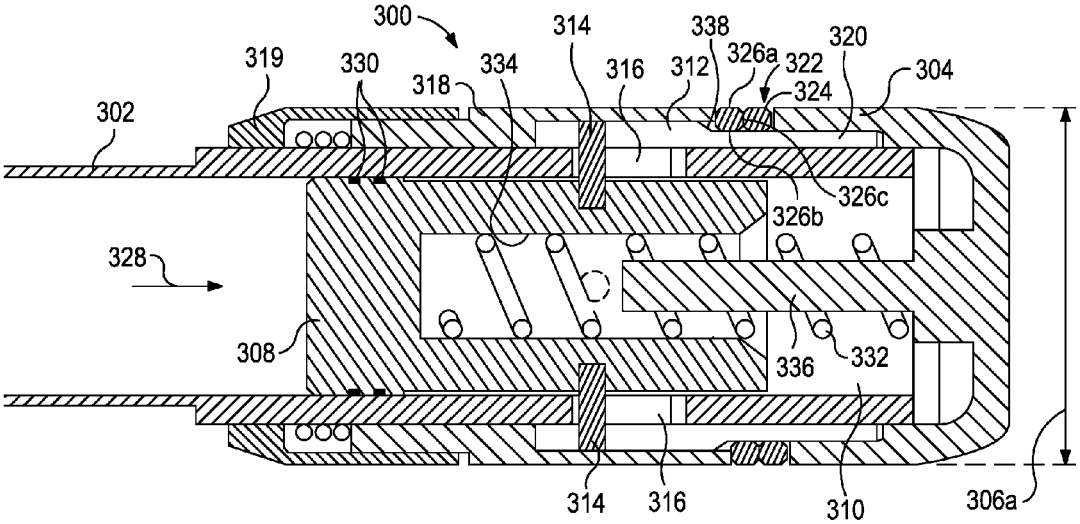

Referring now to FIGS. 3A and 3B, with continued reference to FIGS. 1 and 2A-2C, illustrated are isometric and cross-sectional side views, respectively, of an exemplary bullnose assembly 300, according to one or more embodiments. The bullnose assembly 300 may constitute the distal end of a tool string (not shown), such as a bottom hole assembly or the like, that is conveyed downhole within the main bore 102 (FIG. 1). In some embodiments, the bullnose assembly 300 is conveyed downhole using coiled tubing (not shown). In other embodiments, however, the bullnose assembly 300 may be conveyed downhole using other types of conveyances such as, but not limited to, drill pipe, production tubing, or any other conveyance capable of being fluidly pressurized. In yet other embodiments, the conveyance may be wireline, slickline, or electrical line, without departing from the scope of the disclosure. The tool string may include various downhole tools and devices configured to perform or otherwise undertake various wellbore operations once accurately placed in the downhole environment. The bullnose assembly 300 may be configured to accurately guide the tool string downhole such that it reaches its target destination, e.g., the lateral bore 104 of FIG. 1 or further downhole within the main bore 102.

To accomplish this, the bullnose assembly 300 may include a body 302 and a bullnose tip 304 coupled or otherwise attached to the distal end of the body 302. In some embodiments, the bullnose tip 304 may form an integral part of the body 302 as an integral extension thereof. As illustrated, the bullnose tip 304 may be rounded off at its end or otherwise angled or arcuate such that it does not present sharp corners or angled edges that might catch on portions of the main bore 102 or the deflector 112 (FIG. 1) as it is extended downhole.

Figure 4:
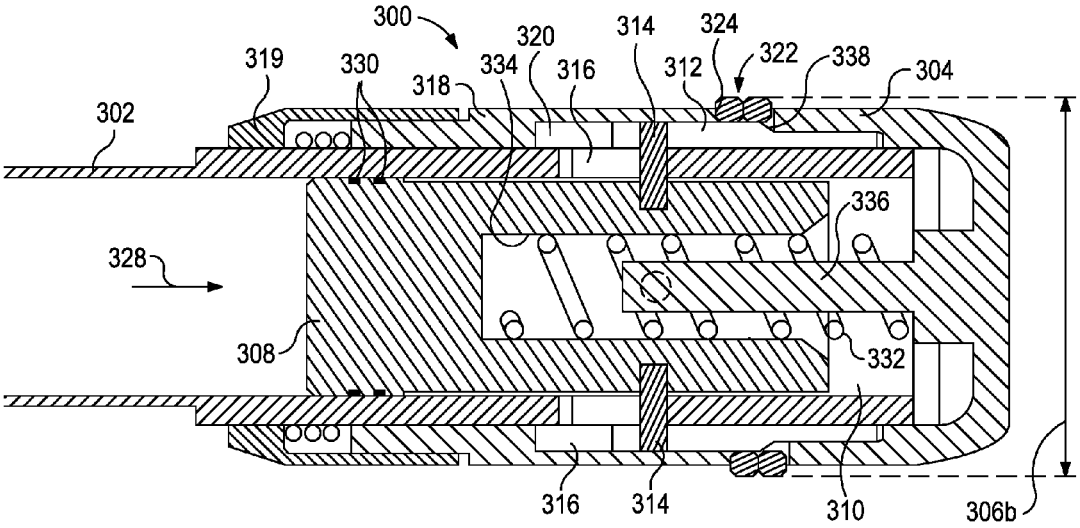
FIG. 4 illustrates the bullnose assembly of FIGS. 3A-3B in its actuated configuration, according to one or more embodiments.

The bullnose assembly 300 is shown in FIGS. 3A and 3B in a default configuration where the bullnose tip 304 exhibits a first diameter 306*a*. The first diameter 306*a* may be less than the predetermined diameter 118 (FIGS. 1 and 2A-2C) of the first channel 116*a*. Consequently, when the bullnose assembly 300 is in the default configuration, it may be sized such that it is able to extend into the first channel 116*a* and into lower portions of the main bore 102. In contrast, as will be discussed in greater detail below, the bullnose assembly 300 is shown in FIG. 4 in an actuated configuration where the bullnose tip 304 exhibits a second diameter 306*b*. The second diameter 306*b* is greater than the first diameter 306*a* and also greater than the predetermined diameter 118 (FIGS. 1 and 2A-2C) of the first channel 116*a*. Consequently, when the bullnose assembly 300 is in its actuated configuration, it may be sized such that it will be directed into the second channel 116*b* via the ramped surface 120 (FIGS. 2A-2C) and subsequently into the lateral bore 104.

In some embodiments, the bullnose assembly 300 may include a piston 308 movably arranged within a piston chamber 310 defined within the bullnose tip 304. The piston 308 may be operatively coupled to a wedge member 312 disposed about the body 302 such that movement of the piston 308 correspondingly moves the wedge member 312. In the illustrated embodiment, one or more coupling pins 314 (two shown) may operatively couple the piston 308 to the wedge member 312. More particularly, the coupling pins 314 may extend between the piston 308 and the wedge member 312 through corresponding longitudinal grooves 316 defined in the body 302.

In other embodiments, however, the piston 308 may be operatively coupled to the wedge member 312 using any other device or coupling method known to those skilled in the art. For example, in at least one embodiment, the piston 308 and the wedge member 312 may be operatively coupled together using magnets (not shown). In such embodiments, one magnet may be installed in one of the piston 308 and the wedge member 312, and another corresponding magnet may be installed in the other of the piston 308 and the wedge member 312. The magnetic attraction between the two magnets may be such that movement of one urges or otherwise causes corresponding movement of the other.

The bullnose tip 304 may include a sleeve 318 and an end ring 319, where the sleeve 318 and the end ring 319 may form part of or otherwise may be characterized as an integral part of the bullnose tip 304. Accordingly, the bullnose tip 304, the sleeve 318, and the end ring 319 may cooperatively define the "bullnose tip." As illustrated, the sleeve 318 generally interposes the end rig 319 and the bullnose tip 304. The wedge member 312 may be secured about the body 302 between the sleeve 318 and the bullnose tip 304. More particularly, the wedge member 312 may be movably arranged within a wedge chamber 320 defined at least partially between the sleeve 318 and the bullnose tip 304 and the outer surface of the body 302. In operation, the wedge member 312 may be configured to move axially within the wedge chamber 320.

The bullnose assembly 300 may further include a coil 322 wrapped about the bullnose tip 304. More particularly, the coil 322 may be arranged within a gap 324 defined between the sleeve 318 and the bullnose tip 304 and otherwise sitting on or engaging a portion of the wedge 312. The coil 322 may be, for example, a helical coil or a helical spring that is wrapped around the bullnose tip 304 one or more times. In other embodiments, however, the coil 322 may be a series of snap rings or the like. In the illustrated embodiment, two wraps or revolutions of the coil 322 are shown, but it will be appreciated that more than two wraps (or a single wrap) may be employed, without departing from the scope of the disclosure. In the default configuration (FIGS. 3A and 3B), the coil 322 sits generally flush with the outer surface of the bullnose tip 304 such that it also generally exhibits the first diameter 306*a*.

In some embodiments, the outer radial surface 326*a* of each wrap of the coil 322 may be generally planar, as illustrated. The inner radial surface 326*b* and the axial sides 326*c* of each wrap of the coil 322 may also be generally planar, as also illustrated. As will be appreciated, the generally planar nature of the coil 322, and the close axial alignment of the sleeve 318 and the bullnose tip 304 with respect to the coil 322, may prove advantageous in preventing the influx of sand or debris into the interior of the bullnose tip 304.

Referring now to FIG. 4, with continued reference to FIGS. 3A-3B, illustrated is the bullnose assembly 300 in its actuated configuration, according to one or more embodiments. In order to move the bullnose assembly 300 from its default configuration (FIGS. 3A-3B) into its actuated configuration (FIG. 4), the wedge member 312 may be actuated such that it moves the coil 322 radially outward to the second diameter 306*b*. In some embodiments, this may be accomplished by applying a hydraulic fluid 328 from a surface location, through the conveyance (i.e., coiled tubing, drill pipe, production tubing, etc.) coupled to the bullnose assembly 300, and from the conveyance to the interior of the bullnose assembly 300 (i.e., the interior of the body 302). At the bullnose assembly 300, the hydraulic fluid 328 enters the body 302 and acts on the piston 308 such that the piston 308 axially translates within the piston chamber 310 towards the distal end of the bullnose tip 304 (i.e., to the right in FIGS. 3B and 4). One or more sealing elements 330 (two shown), such as O-rings or the like, may be arranged between the piston 308 and the inner surface of the piston chamber 310 such that a sealed engagement at that location results.

As the piston 308 translates axially within the piston chamber 310, it engages a biasing device 332 arranged within the piston chamber 310. In some embodiments, the biasing device 332 may be a helical spring or the like. In other embodiments, the biasing device 332 may be a series of Belleville washers, an air shock, or the like, without departing from the scope of the disclosure. In some embodiments, the piston 308 may define a cavity 334 that receives at least a portion of the biasing device 332 therein. Moreover, the bullnose tip 304 may also define or otherwise provide a stem 336 that extends axially from the distal end of the bullnose tip 304 in the uphole direction (i.e., to the left in FIGS. 3A and 3B). The stem 336 may also extend at least partially into the cavity 334. The stem 336 may also be extended at least partially into the biasing device 332 in order to maintain an axial alignment of the biasing device 332 with respect to the cavity 334 during operation. As the piston 308 translates axially within the piston chamber 310, the biasing device 332 is compressed and generates spring force.

Moreover, as the piston 308 translates axially within the piston chamber 310, the wedge member 312 correspondingly moves axially since it is operatively coupled thereto. In the illustrated embodiment, as the piston 308 moves, the coupling pins 314 translate axially within the corresponding longitudinal grooves 316 and thereby move the wedge member 312 in the same direction. As the wedge member 312 axially advances within the wedge chamber 320, the wedge member 312 engages the coil 322 at a beveled surface 338 that forces the coil 322 radially outward to the second diameter 306*b*.

Once it is desired to return the bullnose assembly 300 to its default configuration, the hydraulic pressure on the bullnose assembly 300 may be released. Upon releasing the hydraulic pressure, the spring force built up in the biasing device 332 may force the piston 308 back to its default position, thereby correspondingly moving the wedge member 312 and allowing the coil 322 to radially contract to the position shown in FIGS. 3A-3B. As a result, the bullnose tip 304 may be effectively returned to the first diameter 306*a*. As will be appreciated, such an embodiment allows a well operator to increase the overall diameter of the bullnose tip 304 on demand while downhole simply by applying pressure through the conveyance and to the bullnose assembly 300.

Those skilled in the art, however, will readily recognize that several other methods may equally be used to actuate the wedge member 312, and thereby move the bullnose assembly 300 between the default configuration (FIGS. 3A-3B) and the actuated configuration (FIG. 4). For instance, although not depicted herein, the present disclosure also contemplates using one or more actuating devices to physically adjust the axial position of the wedge member 312 and thereby move the coil 322 to the second diameter 306*b*. Such actuating devices may include, but are not limited to, mechanical actuators, electromechanical actuators, hydraulic actuators, pneumatic actuators, combinations thereof, and the like. Such actuators may be powered by a downhole power unit or the like, or otherwise powered from the surface via a control line or an electrical line. The actuating device (not shown) may be operatively coupled to the piston 308 or the wedge member 312 and otherwise configured to move the wedge member 312 axially within the wedge chamber 320 and thereby force the coil 322 radially outward.

In yet other embodiments, the present disclosure further contemplates actuating the wedge member 312 by using fluid flow around or flowing past the bullnose assembly 300. In such embodiments, one or more ports (not shown) may be defined through the bullnose tip 304 such that the piston chamber 310 is placed in fluid communication with the fluids outside the bullnose assembly 300. A fluid restricting nozzle may be arranged in one or more of the ports such that a pressure drop is created across the bullnose assembly 300. Such a pressure drop may be configured to force the piston 308 toward the actuated configuration (FIG. 4) and correspondingly move the wedge member 312 in the same direction. In yet other embodiments, hydrostatic pressure may be applied across the bullnose assembly 300 to achieve the same end.

While the bullnose assembly 300 described above depicts the bullnose tip 304 as moving between the first and second diameters 306*a,b*, where the first diameter is less than the predetermined diameter 118 and the second diameter is greater than the predetermined diameter, the present disclosure further contemplates embodiments where the dimensions of the first and second diameters 306*a,b* are reversed. More particularly, the present disclosure further contemplates embodiments where the bullnose tip 404 in the default configuration may exhibit a diameter greater than the predetermined diameter and may exhibit a diameter less than the predetermined diameter in the actuated configuration, without departing from the scope of the disclosure. Accordingly, actuating the bullnose assembly 300 may entail a reduction in the diameter of the bullnose tip 304, without departing from the scope of the disclosure.

Figure 5A:
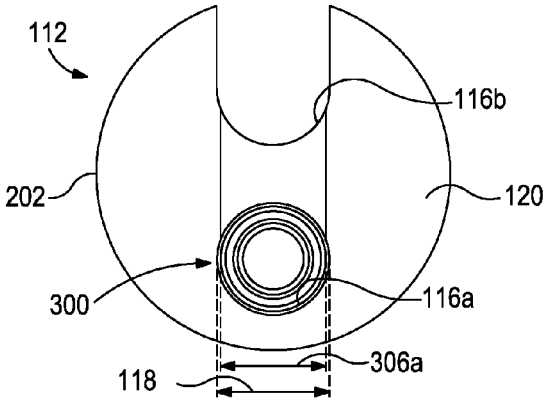
FIGS. 5A and 5B illustrate end and cross-sectional side views, respectively, of the bullnose assembly of FIGS. 3A-3B in its default configuration as it interacts with the deflector of FIGS. 1-2, according to one or more embodiments.
Figure 5B:
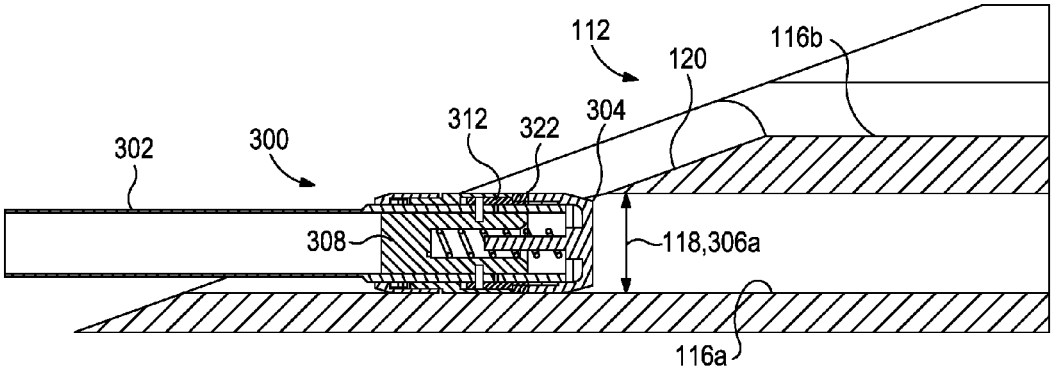

Referring now to FIGS. 5A and 5B, with continued reference to FIGS. 1-4, illustrated are end and cross-sectional side views, respectively, of the bullnose assembly 300 in its default configuration as it interacts with the deflector 112 of FIGS. 1 and 2, according to one or more embodiments. In its default configuration, as discussed above, the bullnose tip 304 exhibits the first diameter 306*a*. The first diameter 306*a* may be less than the predetermined diameter 118 (FIGS. 1 and 2A-2C) of the first channel 116*a*. Consequently, in its default configuration the bullnose assembly 300 may be able to extend through the ramped surface 120 and otherwise into the first channel 116*a* where it will be guided into the lower portions of the main bore 102.

Figure 6A:
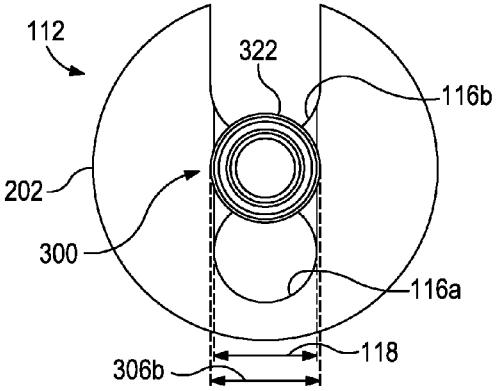
FIGS. 6A and 6B illustrate end and cross-sectional side views, respectively, of the bullnose assembly of FIGS. 3A-3B in its actuated configuration as it interacts with the deflector of FIGS. 1-2, according to one or more embodiments.
Figure 6B:
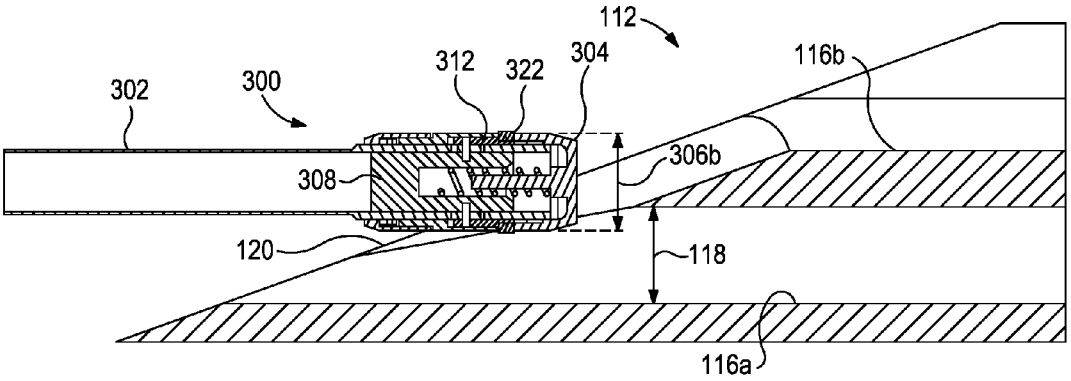

Referring now to FIGS. 6A and 6B, with continued reference to FIGS. 1-4, illustrated are end and cross-sectional side views, respectively, of the bullnose assembly 300 in its actuated configuration as it interacts with the deflector 112 of FIGS. 1 and 2, according to one or more embodiments. In the actuated configuration, the coil 322 has been forced radially outward and thereby effectively increases the diameter of the bullnose tip 304 from the first diameter 306*a* (FIGS. 5A-5B) to the second diameter 306*b*. The second diameter 306*b* is greater than the predetermined diameter 118 (FIGS. 1 and 2A-2C) of the first channel 116*a*. Consequently, upon encountering the deflector 112 in the actuated configuration, the bullnose assembly 300 is prevented from entering the first channel 116*a*, but instead slidingly engages the ramped surface 120 which serves to deflect the bullnose assembly 300 into the second channel 116*b* and subsequently into the lateral bore 104 (FIG. 1).

Figure 7A:
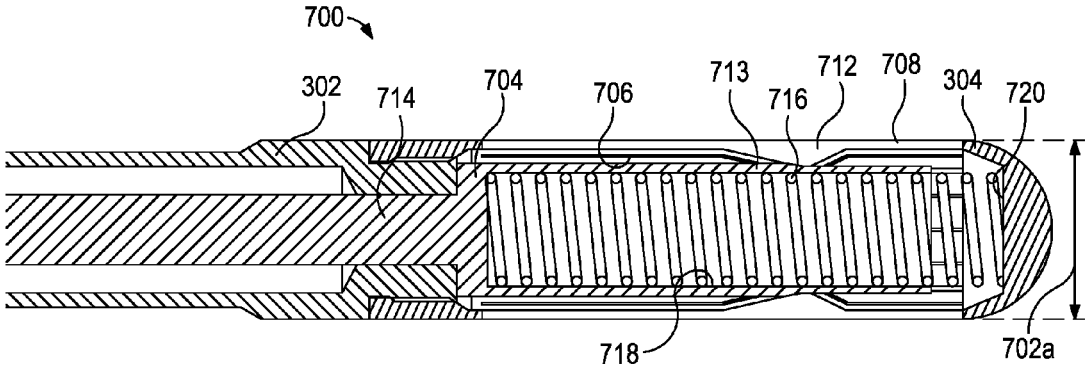
FIGS. 7A and 7B illustrate cross-sectional side views of another exemplary bullnose assembly, according to one or more embodiments.
Figure 7B:
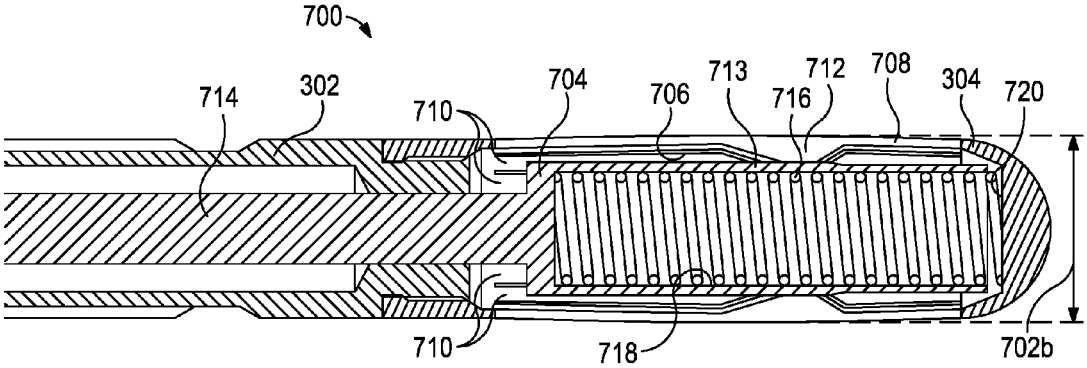

Referring now to FIGS. 7A and 7B, illustrated are cross-sectional side views of another exemplary bullnose assembly 700, according to one or more embodiments. The bullnose assembly 700 may be similar in some respects to the bullnose assembly 300 of FIGS. 3A and 3B and therefore may be best understood with reference thereto, where like numeral will represent like elements not described again in detail. Similar to the bullnose assembly 300, the bullnose assembly 700 may be configured to accurately guide a tool string or the like downhole such that it reaches its target destination, e.g., the lateral bore 104 of FIG. 1 or further downhole within the main bore 102. Moreover, similar to the bullnose assembly 300, the bullnose assembly 700 may be able to alter its diameter such that it is able to interact with the deflector 112 and thereby selectively determine which path to follow (e.g., the main bore 102 or the lateral bore 104).

More particularly, the bullnose assembly 700 is shown in FIG. 7A in its default configuration where the bullnose tip 304 exhibits a first diameter 702*a*. The first diameter 702*a* may be less than the predetermined diameter 118 (FIGS. 1 and 2A-2C) of the first channel 116*a*. Consequently, when the bullnose assembly 700 is in the default configuration, it may be sized such that it is able to extend through the ramped surface 120 (FIGS. 2A-2C) and otherwise into the first channel 116*a* where it will be guided into the lower portions of the main bore 102.

In contrast, the bullnose assembly 700 is shown in FIG. 7B in its actuated configuration where the bullnose tip 304 exhibits a second diameter 702*b*. The second diameter 702*b* is greater than the first diameter 702*a* and also greater than the predetermined diameter 118 (FIGS. 1 and 2A-2C) of the first channel 116*a*. Consequently, upon encountering the deflector 112 in the actuated configuration, the bullnose assembly 700 is prevented from entering the first channel 116*a*, but instead slidingly engages the ramped surface 120 (FIGS. 2A-2C) which deflects the bullnose assembly 700 into the second channel 116*b* and subsequently into the lateral bore 104 (FIG. 1).

In order to move between the default and actuated configurations, the bullnose assembly 700 may include a piston 704 arranged within a piston chamber 706. The piston chamber 706 may be defined within a collet body 708 coupled to or otherwise forming an integral part of the bullnose tip 304. The collet body 708 may define a plurality of axially extending fingers 710 (best seen in FIG. 7B) that are able to flex upon being forced radially outward. The collet body 708 further includes a radial protrusion 712 defined on the inner surface of the collet body 708 and otherwise extending radially inward from each of the axially extending fingers 710. The radial protrusion 712 may be configured to interact with a wedge member 713 defined on the outer surface of the piston 704.

The piston 704 may include a piston rod 714. The piston rod 714 may be actuated axially in order to correspondingly move the piston 704 within the piston chamber 706 such that the wedge member 713 is able to interact with the radial protrusion 712. In some embodiments, similar to the piston 308 of FIG. 3B, the piston rod 714 may be actuated by hydraulic pressure acting on an end (not shown) of the piston rod 714. In other embodiments, however, piston rod 714 may be actuated using one or more actuating devices to physically adjust the axial position of the piston 704. The actuating device (not shown) may be operatively coupled to the piston rod 714 and configured to move the piston 704 back and forth within the piston chamber 706. In yet other embodiments, the present disclosure further contemplates actuating the piston rod 714 using fluid flow around the bullnose assembly 700 or hydrostatic pressure, as generally described above.

As the piston 704 moves axially within the piston chamber 706, it compresses a biasing device 716 arranged within the piston chamber 706. Similar to the biasing device 332 of FIGS. 3A and 4, the biasing device 716 may be a helical spring, a series of Belleville washers, an air shock, or the like. In some embodiments, the piston 308 defines a cavity 718 that receives the biasing device 716 at least partially therein. The opposing end of the biasing device 716 may engage the inner end 720 of the bullnose tip 304. Compressing the biasing device 716 with the piston 704 generates a spring force.

Moreover, as the piston 704 moves axially within the piston chamber 706, the wedge member 713 engages the radial protrusion 712 and forces the axially extending fingers 710 radially outward. This is seen in FIG. 7B. Once forced radially outward, the bullnose tip 304 effectively exhibits the second diameter 702*b*, as described above. To return to the default configuration, the process is reversed and the bullnose tip 304 is returned to the first diameter 702*a*.

Referring again to FIGS. 5A-5B and 6A-6B, with continued reference to FIGS. 7A and 7B, it will be appreciated that the bullnose assembly 300 may be replaced with the bullnose assembly 700 described in FIGS. 7A and 7B, without departing from the scope of the disclosure. For instance, in its default configuration, the bullnose tip 304 of the bullnose assembly exhibits the first diameter 702*a* and therefore is able to extend through the ramped surface 120 and otherwise into the first channel 116*a* where it will be guided into the lower portions of the main bore 102. Moreover, in the actuated configuration, the diameter of the bullnose assembly 700 is increased to the second diameter 702*b*, and therefore, upon encountering the deflector 112 in the actuated configuration, the bullnose assembly 700 is prevented from entering the first channel 116*a*. Rather, the bullnose tip 304 slidingly engages the ramped surface 120 which deflects the bullnose assembly 700 into the second channel 116*b* and subsequently into the lateral bore 104 (FIG. 1).

Accordingly, which bore (e.g., the main bore 102 or the lateral bore 104) a bullnose assembly 300, 700 enters is primarily determined by the relationship between the diameter of the bullnose tip 304 and the predetermined diameter 118 of the first channel 116*a*. As a result, it becomes possible to "stack" multiple junctions 106 (FIG. 1) having the same deflector 112 design in a single multilateral well and entering respective lateral bores 104 at each junction 106 with a single, expandable bullnose assembly 300, 700, all in a single trip into the well.

Figure 8:
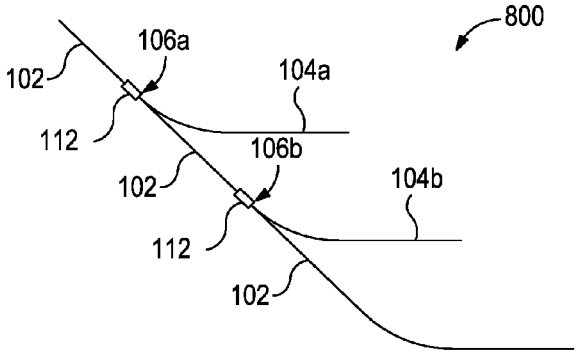
FIG. 8 illustrates an exemplary multilateral wellbore system that may implement the principles of the present disclosure.

Referring to FIG. 8, with continued reference to the previous figures, illustrated is an exemplary multilateral wellbore system 800 that may implement the principles of the present disclosure. The wellbore system 800 may include a main bore 102 that extends from a surface location (not shown) and passes through at least two junctions 106 (shown as a first junction 106*a* and a second junction 106*b*). While two junctions 106*a,b* are shown in the wellbore system 800, it will be appreciated that more than two junctions 106*a,b* may be utilized, without departing from the scope of the disclosure.

At each junction 106*a,b*, a lateral bore 104 (shown as first and second lateral bores 104*a* and 104*b*, respectively) extends from the main bore 102. A third lateral bore 104*c* may extend from the distal end of the main bore 102 and otherwise encompass a deviated section of the main bore 102. The deflector 112 of FIGS. 2A-2C may be arranged at each junction 106*a,b*. Accordingly, each junction 106*a,b* includes a deflector 112 having a first channel 116*a* that exhibits a first diameter 118 and a second channel 116*b*.

In exemplary operation, an expandable bullnose assembly, such as the bullnose assemblies 300, 700 described herein, may be introduced downhole and actuated in order to enter the first and second lateral bores 104*a,b* at each junction 106*a,b*, respectively. For instance, if it is desired to enter the first lateral bore 104*a*, the bullnose assembly 300, 700 may be actuated prior to reaching the deflector 112 at the first junction 106*a*. As a result, the bullnose assembly 300, 700 will exhibit the second diameter 306*b*, 702*b* and thereby be directed into the second channel 116*b* since the second diameter 306*b*, 702*b* is greater than the predetermined diameter 118 of the first channel 116*a*. Otherwise, the bullnose assembly 300, 700 may remain in its default configuration with the first diameter 306*a*, 702*a* and pass through the first channel 116*a* of the deflector 112 at the first junction 106*a*.

Once past the first junction 106*a*, the bullnose assembly 300, 700 may enter the second lateral bore 104*b* by being actuated prior to reaching the deflector 112 at the second junction 106*b*. As a result, the bullnose assembly 300, 700 will again exhibit the second diameter 306*b*, 702*b* and thereby be directed into the second channel 116*b* at the deflector 112 of the second junction 106*b* since the second diameter 306*b*, 702*b* is greater than the predetermined diameter 118 of the first channel 116*a*. If it is desired to pass through the deflector 112 of the second junction 106*b* and into the lower portions of the main bore 102 and possibly the third lateral bore 104*c*, the bullnose assembly 300, 700 may remain in its default configuration with the first diameter 306*a*, 702*a* and pass through the first channel 116*a* of the deflector 112 at the second junction 106*b*.

Embodiments disclosed herein include:

A. A method that includes introducing a bullnose assembly into a main bore of a wellbore, the bullnose assembly including a body and a bullnose tip actuatable between a default configuration, where a collet body forming part of the bullnose tip exhibits a first diameter, and an actuated configuration, where the collet body exhibits a second diameter different than the first diameter, advancing the bullnose assembly to a deflector arranged within the main bore and defining a first channel that exhibits a predetermined diameter and communicates with a lower portion of the main bore, and a second channel that communicates with a lateral bore, and directing the bullnose assembly into either the lower portion of the main bore or the lateral bore based on a diameter of the collet body as compared to the predetermined diameter.

B. A method that includes introducing a bullnose assembly into a main bore having a first junction and a second junction spaced downhole from the first junction, the bullnose assembly including a body and a bullnose tip arranged at a distal end of the body and actuatable between a default configuration, where a collet body forming part of the bullnose tip exhibits a first diameter, and an actuated configuration, where the collet body exhibits a second diameter different than the first diameter, advancing the bullnose assembly to a first deflector at the first junction, the first deflector defining a first channel that exhibits a predetermined diameter and communicates with a first lower portion of the main bore, and a second channel that communicates with a first lateral bore, and directing the bullnose assembly into one of the first lower portion of the main bore and the first lateral bore based on a diameter of the collet body as compared to the predetermined diameter.

Each of embodiments A and B may have one or more of the following additional elements in any combination: Element 1: wherein the first diameter is less than the predetermined diameter and the second diameter is greater than both the first diameter and the predetermined diameter, the method further comprising guiding the bullnose assembly to the second channel with a ramped surface included in the deflector when the bullnose assembly is in the actuated configuration. Element 2: further comprising actuating the bullnose assembly to move the bullnose assembly between the default configuration and the actuated configuration. Element 3: wherein actuating the bullnose assembly comprises moving a piston arranged within a piston chamber defined within the collet body, the collet body defining a plurality of axially extending fingers, moving a wedge member defined on an outer surface of the piston into engagement with a radial protrusion defined on an inner surface of the collet body and extending radially inward from each axially extending finger, and forcing the plurality of axially extending fingers radially outward with the wedge member, wherein, when the plurality of axially extending fingers is forced radially outward, the diameter of the collet body exceeds the predetermined diameter. Element 4: wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber.

Element 5: wherein the first diameter is less than the predetermined diameter and the second diameter is greater than both the first diameter and the predetermined diameter, the method further comprising actuating the bullnose assembly to move the bullnose assembly from the default configuration to the actuated configuration. Element 6: wherein actuating the bullnose assembly comprises moving a piston arranged within a piston chamber defined within the collet body that forms at least part of the bullnose tip, the collet body defining a plurality of axially extending fingers, moving a wedge member defined on an outer surface of the piston into engagement with a radial protrusion defined on an inner surface of the collet body and extending radially inward from each axially extending finger, and forcing the plurality of axially extending fingers radially outward with the wedge member, wherein, when the plurality of axially extending fingers is forced radially outward, the diameter of the collet body exceeds the predetermined diameter. Element 7: wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber. Element 8: further comprising advancing the bullnose assembly to a second deflector at the second junction, the second deflector defining a third channel that exhibits the predetermined diameter and communicates with a second lower portion of the main bore, and a fourth channel that communicates with a second lateral bore, and directing the bullnose assembly into one of the second lower portion of the main bore and the second lateral bore based on the diameter of the collet body as compared to the predetermined diameter. Element 9: further comprising, when the bullnose assembly is in the actuated configuration, guiding the bullnose assembly to one of the second and fourth channels with a ramped surface included in the first and second deflectors, respectively. Element 10: wherein the first diameter is less than the predetermined diameter and the second diameter is greater than both the first diameter and the predetermined diameter, the method further comprising actuating the bullnose assembly to move the bullnose assembly from the default configuration to the actuated configuration. Element 11: wherein actuating the bullnose assembly comprises moving a piston arranged within a piston chamber defined within the collet body, the collet body defining a plurality of axially extending fingers, moving a wedge member defined on an outer surface the piston into engagement with a radial protrusion defined on an inner surface of the collet body and extending radially inward from each axially extending finger, and forcing the plurality of axially extending fingers radially outward with the wedge member, wherein, when the plurality of axially extending fingers is forced radially outward, the diameter of the collet body exceeds the predetermined diameter. Element 12: wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber.

By way of non-limiting example, exemplary combinations applicable to A and B include: Element 2 with Element 3; Element 3 with Element 4; Element 5 with Element 6; Element 6 with Element 7; Element 8 with Element 9; Element 9 with Element 10; Element 10 with Element 11; and Element 11 with Element 12.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method, comprising:

introducing a bullnose assembly into a main bore of a wellbore, the bullnose assembly including a body and a bullnose tip actuatable between a default configuration, where a collet body forming part of the bullnose tip exhibits a first diameter, and an actuated configuration, where the collet body exhibits a second diameter different than the first diameter;

advancing the bullnose assembly to a deflector arranged within the main bore and defining a first channel that exhibits a predetermined diameter and communicates with a lower portion of the main bore, and a second channel that communicates with a lateral bore; and directing the bullnose assembly into either the lower portion of the main bore or the lateral bore based on a diameter of the collet body as compared to the predetermined diameter.

2. The method of claim 1, wherein the first diameter is less than the predetermined diameter and the second diameter is greater than both the first diameter and the predetermined diameter, the method further comprising guiding the bullnose assembly to the second channel with a ramped surface included in the deflector when the bullnose assembly is in the actuated configuration.

3. The method of claim 1, further comprising actuating the bullnose assembly to move the bullnose assembly between the default configuration and the actuated configuration.

4. The method of claim 3, wherein actuating the bullnose assembly comprises:

moving a piston arranged within a piston chamber defined within the collet body, the collet body defining a plurality of axially extending fingers;

moving a wedge member defined on an outer surface of the piston into engagement with a radial protrusion defined on an inner surface of the collet body and extending radially inward from each axially extending finger; and forcing the plurality of axially extending fingers radially outward with the wedge member, wherein, when the plurality of axially extending fingers is forced radially outward, the diameter of the collet body exceeds the predetermined diameter.

5. The method of claim 4, wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber.

6. A method, comprising:

introducing a bullnose assembly into a main bore having a first junction and a second junction spaced downhole from the first junction, the bullnose assembly including a body and a bullnose tip arranged at a distal end of the body and actuatable between a default configuration, where a collet body forming part of the bullnose tip exhibits a first diameter, and an actuated configuration, where the collet body exhibits a second diameter different than the first diameter;

advancing the bullnose assembly to a first deflector at the first junction, the first deflector defining a first channel that exhibits a predetermined diameter and communicates with a first lower portion of the main bore, and a second channel that communicates with a first lateral bore; and directing the bullnose assembly into one of the first lower portion of the main bore and the first lateral bore based on a diameter of the collet body as compared to the predetermined diameter.

7. The method of claim 6, wherein the first diameter is less than the predetermined diameter and the second diameter is greater than both the first diameter and the predetermined diameter, the method further comprising actuating the bullnose assembly to move the bullnose assembly from the default configuration to the actuated configuration.

8. The method of claim 7, wherein actuating the bullnose assembly comprises:

moving a piston arranged within a piston chamber defined within the collet body that forms at least part of the bullnose tip, the collet body defining a plurality of axially extending fingers;

moving a wedge member defined on an outer surface of the piston into engagement with a radial protrusion defined on an inner surface of the collet body and extending radially inward from each axially extending finger; and forcing the plurality of axially extending fingers radially outward with the wedge member, wherein, when the plurality of axially extending fingers is forced radially outward, the diameter of the collet body exceeds the predetermined diameter.

9. The method of claim 8, wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber.

10. The method of claim 6, further comprising:

advancing the bullnose assembly to a second deflector at the second junction, the second deflector defining a third channel that exhibits the predetermined diameter and communicates with a second lower portion of the main bore, and a fourth channel that communicates with a second lateral bore; and directing the bullnose assembly into one of the second lower portion of the main bore and the second lateral bore based on the diameter of the collet body as compared to the predetermined diameter.

11. The method of claim 10, further comprising, when the bullnose assembly is in the actuated configuration, guiding the bullnose assembly to one of the second and fourth channels with a ramped surface included in the first and second deflectors, respectively.

12. The method of claim 11, wherein the first diameter is less than the predetermined diameter and the second diameter is greater than both the first diameter and the predetermined diameter, the method further comprising actuating the bullnose assembly to move the bullnose assembly from the default configuration to the actuated configuration.

13. The method of claim 12, wherein actuating the bullnose assembly comprises:

moving a piston arranged within a piston chamber defined within the collet body, the collet body defining a plurality of axially extending fingers;

moving a wedge member defined on an outer surface the piston into engagement with a radial protrusion defined on an inner surface of the collet body and extending radially inward from each axially extending finger; and forcing the plurality of axially extending fingers radially outward with the wedge member, wherein, when the plurality of axially extending fingers is forced radially outward, the diameter of the collet body exceeds the predetermined diameter.

14. The method of claim 13, wherein moving the piston within the piston chamber comprises at least one of applying hydraulic pressure on the piston, actuating the piston with an actuating device operatively coupled to the piston, and creating a pressure drop across the bullnose assembly that forces the piston to move within the piston chamber.

* * * * *